US005324043A

United States Patent [19]

Estrella

[11] Patent Number: 5,324,043

[45] Date of Patent: Jun. 28, 1994

[54] AUTOMATED TARGET RESETTING SYSTEM

[76] Inventor: Randall P. Estrella, 42712 32nd St., West, Quartz Hill, Calif. 93536

[21] Appl. No.: 71,069

[22] Filed: Jun. 4, 1993

[51] Int. Cl.[5] ..... F41J 7/04

[52] U.S. Cl. ..... 273/392; 273/391

[58] Field of Search ..... 273/392, 391

[56] References Cited

U.S. PATENT DOCUMENTS

| | | | |
|---|---|---|---|
| 996,712 | 7/1911 | Harper | 273/392 |
| 1,098,255 | 5/1914 | Harper | 273/392 |
| 2,561,733 | 7/1951 | Foyst | 273/391 X |
| 3,844,559 | 10/1974 | Davidson et al. | 273/391 X |
| 4,540,182 | 9/1985 | Clement | 273/392 |
| 4,588,194 | 5/1986 | Steidle et al. | 273/391 |
| 4,949,980 | 8/1990 | Hoy | 273/391 |
| 5,263,722 | 11/1993 | Rosellen | 273/391 |

*Primary Examiner*—William H. Grieb
*Attorney, Agent, or Firm*—Charles H. Thomas

[57] ABSTRACT

An automatic shooting target system is provided with an automatic target resetting arrangement that returns all of a plurality of laterally spaced targets to an upright disposition. Each of the targets is carried by a set of separate target mounting arms that are mounted for independent rotation about a target mounting shaft. The target resetting mechanism is formed by target resetting levers that are locked to the target mounting shaft for rotation therewith. A reset biasing mechanism, which may be a wound band spring that urges a ratchet wheel in rotation, is coupled to urge the target mounting shaft in rotation in a direction that resets the targets concurrently by means of the target resetting levers. However, a rotation inhibiting device, such as a sear, obstructs rotation of the ratchet wheel, and therefore rotation of the target mounting shaft, in the reset direction. Control rods are operable by movement of at least one of the targets from the upright to the fallen position to temporarily disable the rotation inhibiting sear. This allows the band spring to rotate the target mounting shaft in the reset direction, whereby the target reset mechanism concurrently carries all of the targets from their fallen position to their upright positions.

19 Claims, 10 Drawing Sheets

AUTOMATED TARGET RESETTING SYSTEM

BACKGROUND OF THE INVENTION

1. Field of the Invention

The present invention relates to a system for automatically resetting an array of targets in a target shooting system.

2. Description of the Prior Art

In conventional target shooting systems, particularly target systems of firearms, a plurality of targets are typically lines up at laterally spaced positions to project above a target mounting frame. The targets are usually separately mounted by means of arms that are secured for rotation about a target mounting shaft that is protected behind the target mounting frame. The arms for each target are rotatable independently of each other about the target mounting shaft.

A target shooter, standing at a firing line located a prescribed distance from the target mounting frame, fires a firearm while aiming at a particular target in the array. If the shot is on target, the impact of the projectile against the target carries the target rearwardly in rotation by virtue of the hinged mounting arm connection. Upon impact, the target moves from an upright position in which it is visible above the target mounting frame to a fallen position vertically lower than the upright position. In the fallen position the target is concealed behind the target mounting frame. The target shooter is apprised of the accuracy of the shot by whether or not the intended target is knocked down.

Once all of the targets in an array have been successfully knocked down, it is necessary for them to be reset. This can be done by physically moving to the area at the rear of the target mounting frame, and manually counter-rotating each target about the target mounting shaft in a target resetting direction to return the targets from their fallen positions to their upright positions in which they are again visible above the target mounting frame. However, manual resetting of targets is both time consuming and tedious. Moreover, there is always a certain danger to an individual in manually resetting targets, since it is possible that other shooters may not be aware of the presence of the person resetting the targets in the area behind the target mounting frame.

Systems have been designed to remotely reset targets from their fallen to their upright positions. However, such systems are not automated, and are rather primitive in their operation. For example, one such conventional system provides a target resetting apparatus which is mounted for rotation about the target mounting shaft. The apparatus includes levers that are capable of concurrently engaging the target mounting arms from behind and for carrying the targets concurrently to an upright disposition. However, actuation of this resetting mechanism is performed by pulling on a rope or other flexible line that is coupled to a crank arm that operates the target resetting mechanism. Although the system does provide for remote resetting of the targets, it is entirely manually operated.

SUMMARY OF THE INVENTION

The present invention involves a system for concurrently and automatically resetting a plurality of targets that are mounted for rotation on a target mounting frame. The system of the invention is automated, in that once the last target, or a selected target, has been knocked down, all of the fallen targets are automatically reset from their fallen positions to their upright positions. No manual actuation of the resetting mechanism is required, as the system is triggered to operate by a shot striking the last target in an array, or a specified target in a target array.

In one broad aspect the present invention may be considered to be an improvement in a target apparatus employing a plurality of targets fastened to a target mounting frame in which each target is independently mounted for rotation about a common horizontal target mounting shaft wherein the targets are rotatable between an upright position and a lower, fallen position. The improvement of the invention includes a target resetting-mechanism, a reset biasing means, a rotation inhibiting mechanism, a latch mechanism, and a latch control mechanism. The target resetting mechanism is rigidly secured to the target mounting shaft and is operable to rotate in a target resetting direction to engage all of the targets in the fallen position so as to concurrently rotate them into the upright position. The reset biasing means is coupled to the target resetting mechanism to urge the target resetting mechanism in rotation in the target resetting direction. The rotation inhibiting mechanism is secured to the target mounting frame. The latch mechanism holds the rotation inhibiting mechanism in position to obstruct rotation of the target resetting mechanism in the resetting direction. The latch control mechanism is operated by at least one of the targets moving from the upright position to the fallen position to release the latch mechanism so as to temporarily disable the rotation inhibiting mechanism.

The target resetting mechanism may be constructed so that the latch mechanism is not released until all of the targets have been hit and are in the fallen position. Alternatively, the system can be arranged so that a single particular target controls the operation of the reset mechanism. That is, the system can be arranged so that all of the targets that have been hit will remain in a fallen position until a final, specified target is hit. The fall of this final target will then automatically actuate the target resetting system.

In anther broad aspect the invention may be considered to be an automatic shooting target system comprising a target mounting frame, a horizontally disposed target mounting shaft secured to the target mounting frame for rotation relative thereto in both a reset direction and an opposite direction, a plurality of targets each carried by separate target mounting arms which are mounted for independent rotation about the target mounting shaft between upright positions and fallen positions that are at a vertically lower level than the upright positions, a target reset mechanism secured to and rotatable with the target mounting shaft and having lever arms for engaging the targets to concurrently bring all of the targets to their upright positions when the mounting shaft rotates in the reset direction, reset biasing means coupled to urge the target mounting shaft in rotation in the reset direction, rotation inhibiting means for obstructing rotation of the target mounting shaft in the reset direction, and control means operable by movement of at least one of the targets from the upright to the fallen position to temporarily disable the rotation inhibiting means. Disablement of the rotation inhibiting means allows the biasing means to rotate the target mounting shaft in the reset direction, whereby the target reset mechanism concurrently carries all targets in the fallen position to the upright position.

The invention may be described with greater clarity and particularity by reference to the accompanying drawings.

DESCRIPTION OF THE EMBODIMENT

Figures 1, 2:
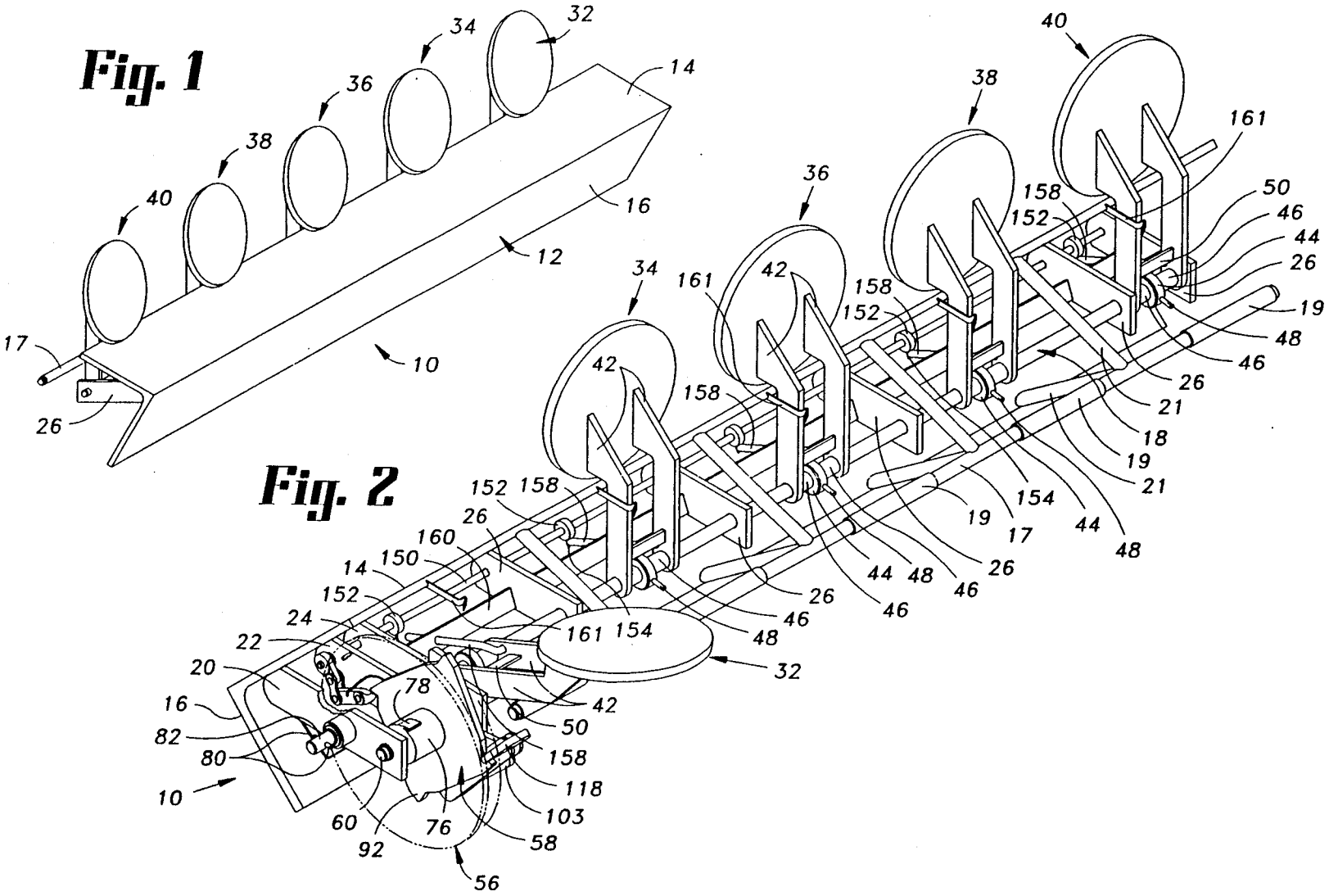
FIG. 1 is a front perspective view of a preferred embodiment of the automatic shooting target system of the invention.
FIG. 2 is a rear perspective view of the target system of FIG. 1 showing four of the targets in the upright position and one of the targets in the fallen position.

FIGS. 1 and 2 illustrate an automated resettable shooting target system indicated generally at 10. The target system 10 is comprised of a target mounting frame 12 formed in the shape of a horizontally disposed angle by an upwardly and rearwardly inclined plate 14 and a downwardly and rearwardly inclined plate 16, both of which are oriented at forty five degrees relative to horizontal. The plates 14 and 16 are each about three and one half feet long by six inches in width and three eighths of an inch in thickness. The plates 14 and 16 are welded where they intersect together at a ninety degree angle. The frame 12 is typically mounted atop some upright stanchions or other supports, not shown, to hold the frame 12 at a suitable vertical level.

The target system 10 further includes a horizontally disposed target mounting shaft 18 formed of a one half inch diameter steel rod that extends the major portion of the length of the target system 10. The target mounting shaft 18 is secured to the target mounting frame 12 for rotation relative thereto by means of horizontally extending mounting brackets 24 and 26. The mounting brackets are welded to the back sides of the steel plates 14 and 16 at the intersections thereof. The target mounting shaft 18 is mounted for rotation relative to the mounting frame 12 in both a target resetting direction, indicated by the directional arrow 30 in FIG. 2*a*, and in an opposite direction.

Five different targets 32, 34, 36, 38 and 4.0, each formed of a steel plate about six inches in diameter and about five sixteenths of an inch thick, are mounted for rotation independent of each other relative to the target frame 10 and about the target mounting shaft 18. The targets 32–40 each fall upon impact from an upright position to a fallen position vertically lower than the upright position. The target 32 is illustrated in the fallen position while the targets 34–40 are illustrated in their upright positions in FIG. 2.

To travel between the upright position and the fallen position, each of the targets 32–40 travels though an arc of about sixty degrees. Each of the targets 32–40 is mounted for rotation about the target mounting shaft 18 independently of each other target by means of a pair of mounting arms 42. Each pair of target mounting arms 42 is mounted for independent rotation about the target mounting shaft 18. As the targets are struck they fall back against a longitudinally extending steel limit rod 17 having annular cushioning sleeves 19 thereon located directly behind the target mounting arms 42. The target limit rod 17 is held in position parallel to the target mounting shaft 18 and behind the targets 32–40 by bracing rods 21, which are welded both to the target mounting frame 12 and to the target limit rod 17.

The Target Reset Mechanism

The target reset mechanism is comprised of a plurality of separate annular collars 44 that are all secured by allen head set screws to the target mounting shaft 18 at longitudinally spaced intervals therealong. Annular spacing sleeves 46 are loosely disposed about the target mounting shaft 18 on both sides of each collar 44 in order to maintain the mounting arms 42 for each target spaced equidistant from the collar 44 associated with that target. Each collar 44 has a target reset lever arm 48 projecting radially outwardly therefrom. The target reset lever arms 48 are configured to engage their respective targets through cross braces 50 that extend between the mounting arms 42 in each pair for each target. The target reset lever arms 48 are all arranged to move in tandem and at all times reside in a common plane which intersects and contains the axis of the target mounting shaft 18, so that the target reset lever arms 48 are all at the same angle of inclination relative to horizontal.

Figure 2A:
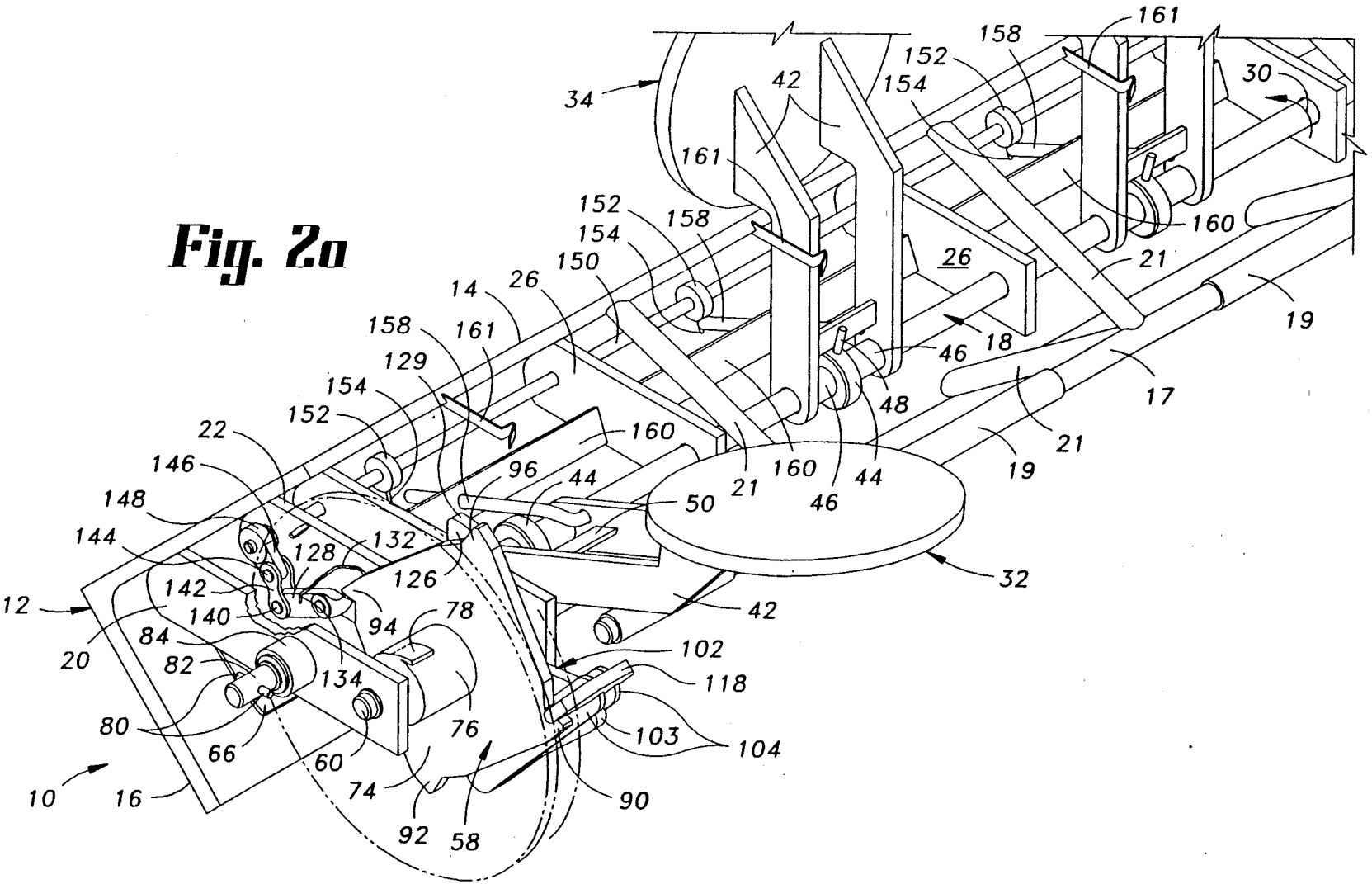
FIG. 2*a* is an enlarged detail of a portion of FIG. 2.
Figure 3:
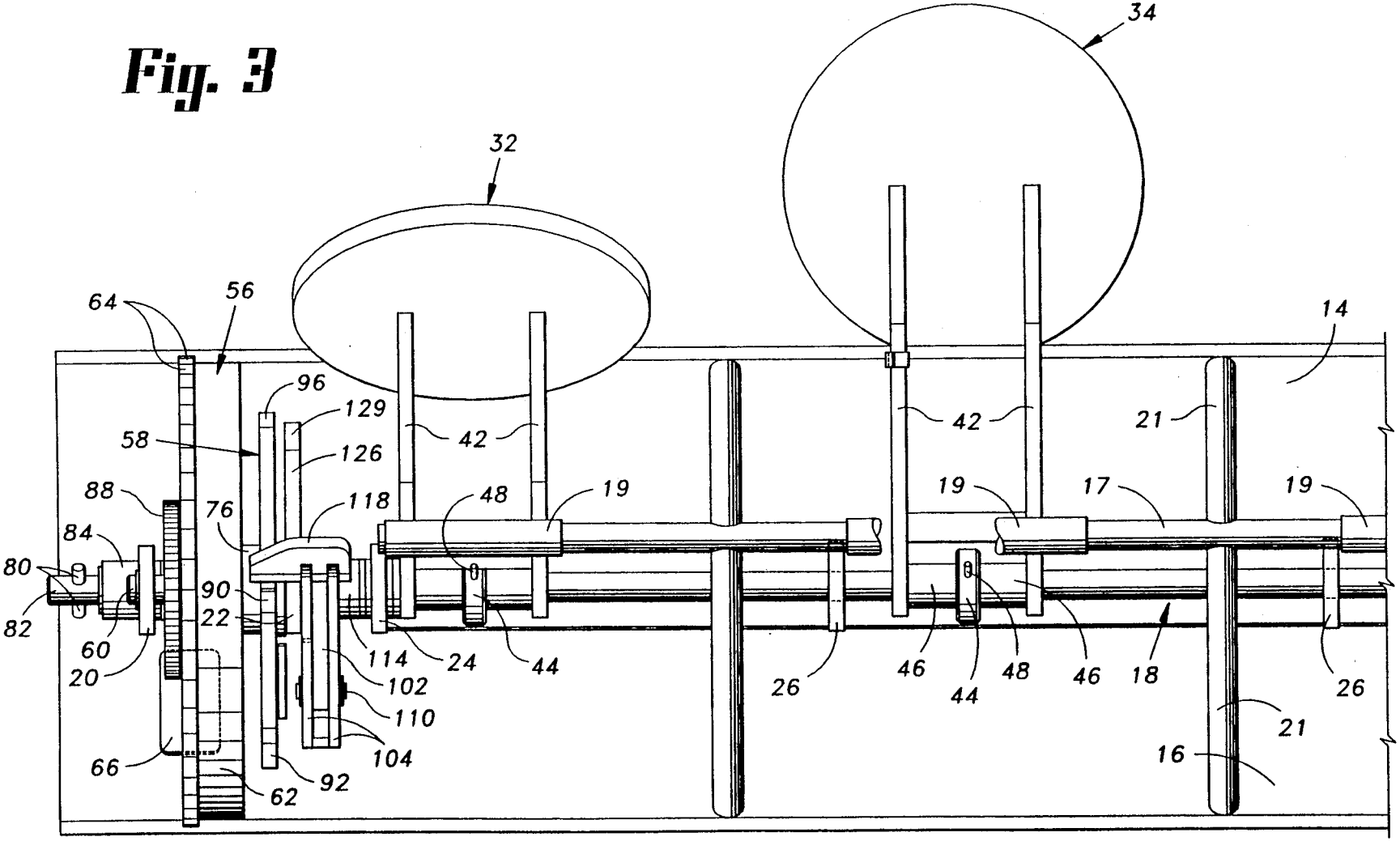
FIG. 3 is a rear elevational view of the targets shown fully in FIG. 2*a*.

Since the collars 44 are all rigidly secured to the target mounting shaft 18, they rotate concurrently therewith to carry all of the targets 32–40 in rotation about the target mounting shaft 18 in the target resetting direction 30, shown in FIG. 2*a*, upon contact with their respective targets. This occurs when the target mounting shaft 18 is rotated in the target resetting direction 30 shown in FIG. 2*a*. In this way the target reset mechanism which includes the collars 44 and target reset lever arms 48, is coupled to the target mounting shaft 18 to rotate therewith and to engage the targets 32–40 from behind for rotating them together from their fallen positions, at which target 32 resides in FIG. 2, to their upright positions, in which the targets 34–40 are shown in FIG. 2, upon rotation of the target mounting shaft 18 in the target resetting direction 30.

The Target Reset Biasing Mechanism

The target system 10 is also equipped with a target reset biasing means that includes a helically wound band spring assembly, indicated generally at 56 and a ratchet wheel 58. The helically wound band spring assembly 56 is mounted coaxially with and adjacent to the ratchet wheel 58, both of which mounted adjacent each other for mutually independent rotation on a short axle 60 between the horizontally projecting mounting brackets 20 and 24.

Figure 8:
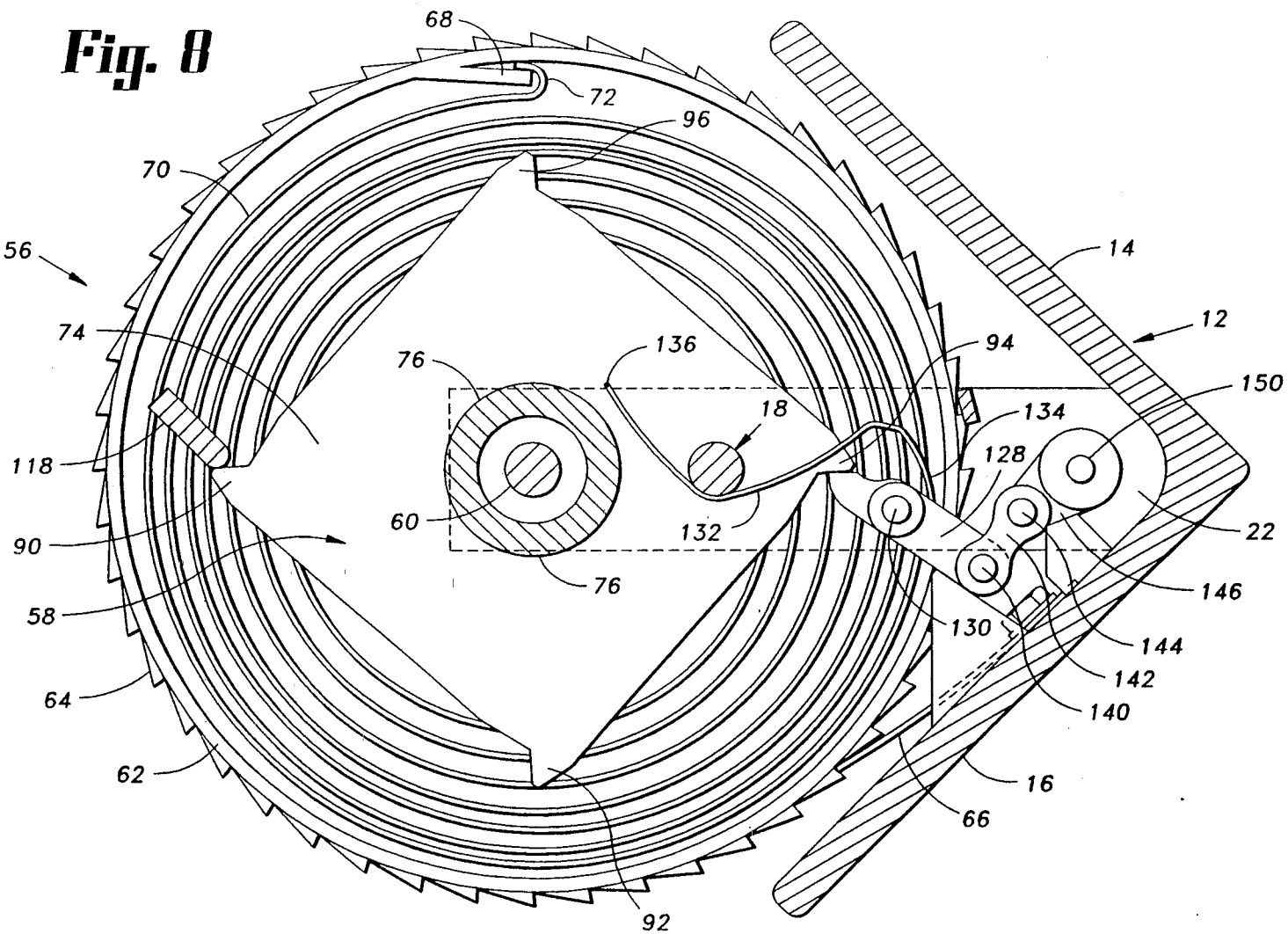
FIG. 8 is a sectional elevational view taken along the lines 8—8 of FIG. 4.

The helically wound band spring assembly 56 is illustrated in detail in FIG. 8 and includes a drum shaped spring housing 62, open on the side facing the ratchet wheel 58 and closed on its opposite side. About the periphery of the spring housing 62 there are a multiplicity of spring assembly ratchet teeth 64 which are engageable with a spring steel strip 66 that is bolted to the lower plate 16 of the mounting frame 12, as illustrated in FIG. 8. On its inner surface the drum shaped spring housing 62 has an anchoring tab 68 projecting in the target resetting direction. Within the spring housing 62 there is a heavy helically wound band spring 70, the outer peripheral end 72 of which is bent over to engage the anchoring tab 68 on the interior of the spring housing 62.

The ratchet wheel 58 is constructed of a flat steel plate 74 configured in a generally square shape with four teeth 90, 92, 94 and 96 located at each of its four corners, and is oriented normal to the axle 60. The plate 74 is welded to a cylindrical annular hub 76 that extends longitudinally in both directions from the plate 74. One portion of the hub 76 of the ratchet wheel 58 extends into the confines of the spring drum housing 62. This portion of the hub 76 has an anchoring tab 78 welded thereto, shown in FIGS. 2 and 2*a*, which is inclined outwardly in a direction opposite to the target resetting direction 30. The helical inner end of the band spring 70 is bent and hooked over the anchoring tab 78 on the ratchet wheel hub 76 in a similar manner but in a direction opposite to the engagement of the outer hooked end 72 on the anchoring tab 68 shown in FIG. 8.

Figure 4:
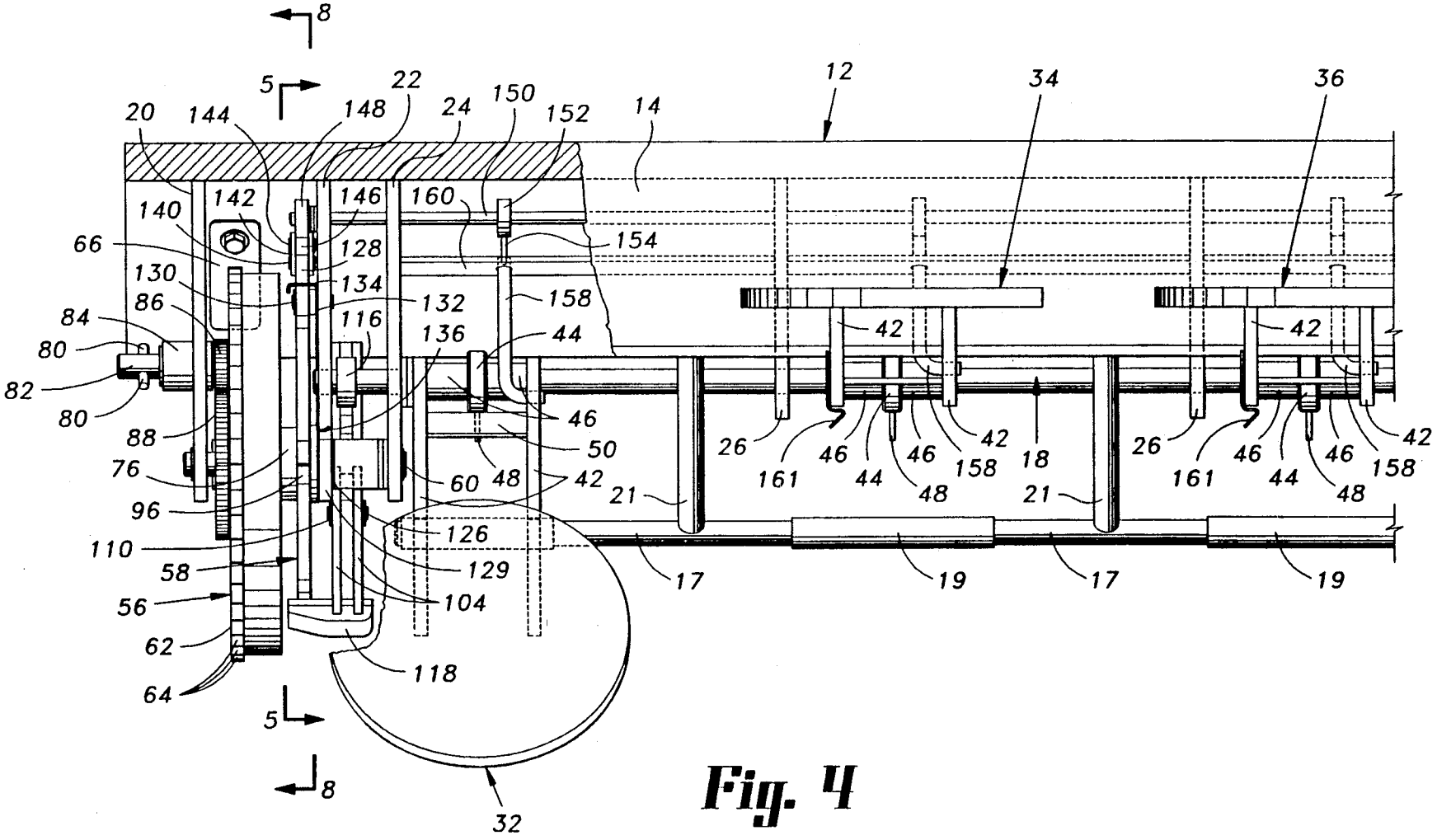
FIG. 4 is a top plan view, partially broken away, of the portion of the target shooting system shown in FIG. 2*a*.
Figure 9:
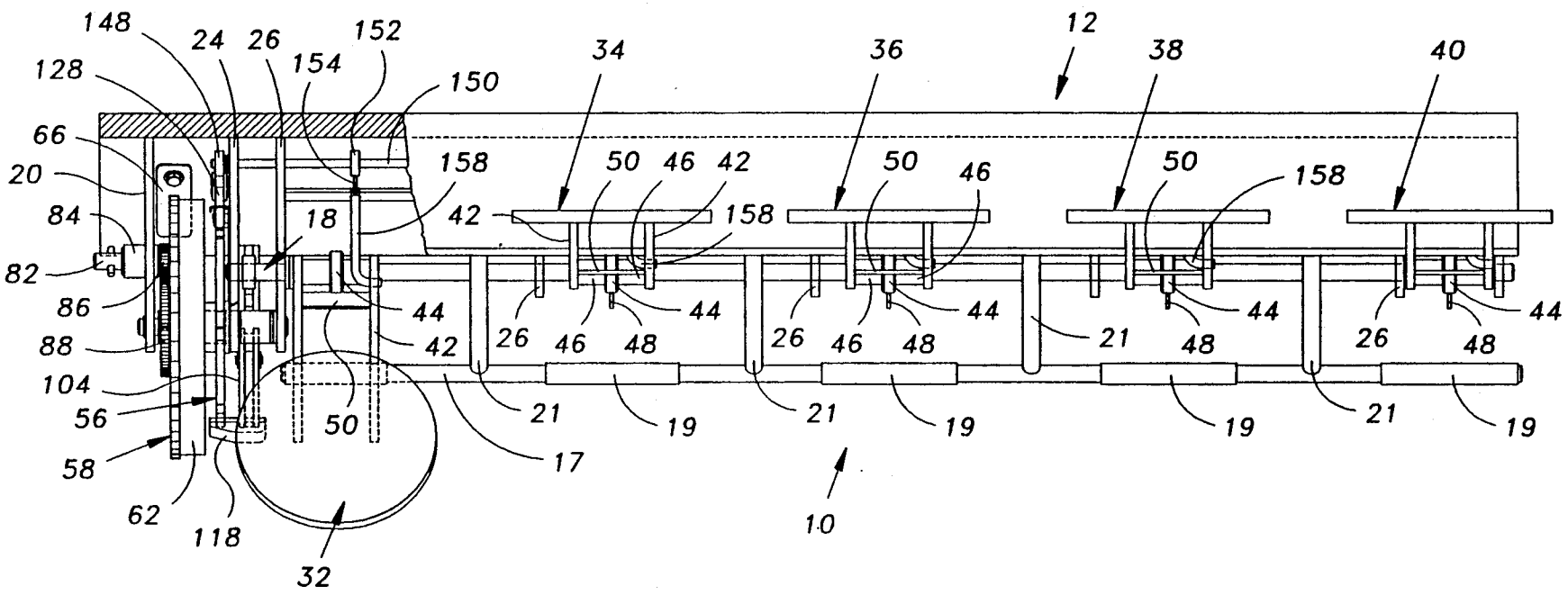
FIG. 9 is a top plan view, partially broken away, of the embodiment of the invention as shown in FIG. 2.
Figure 10:
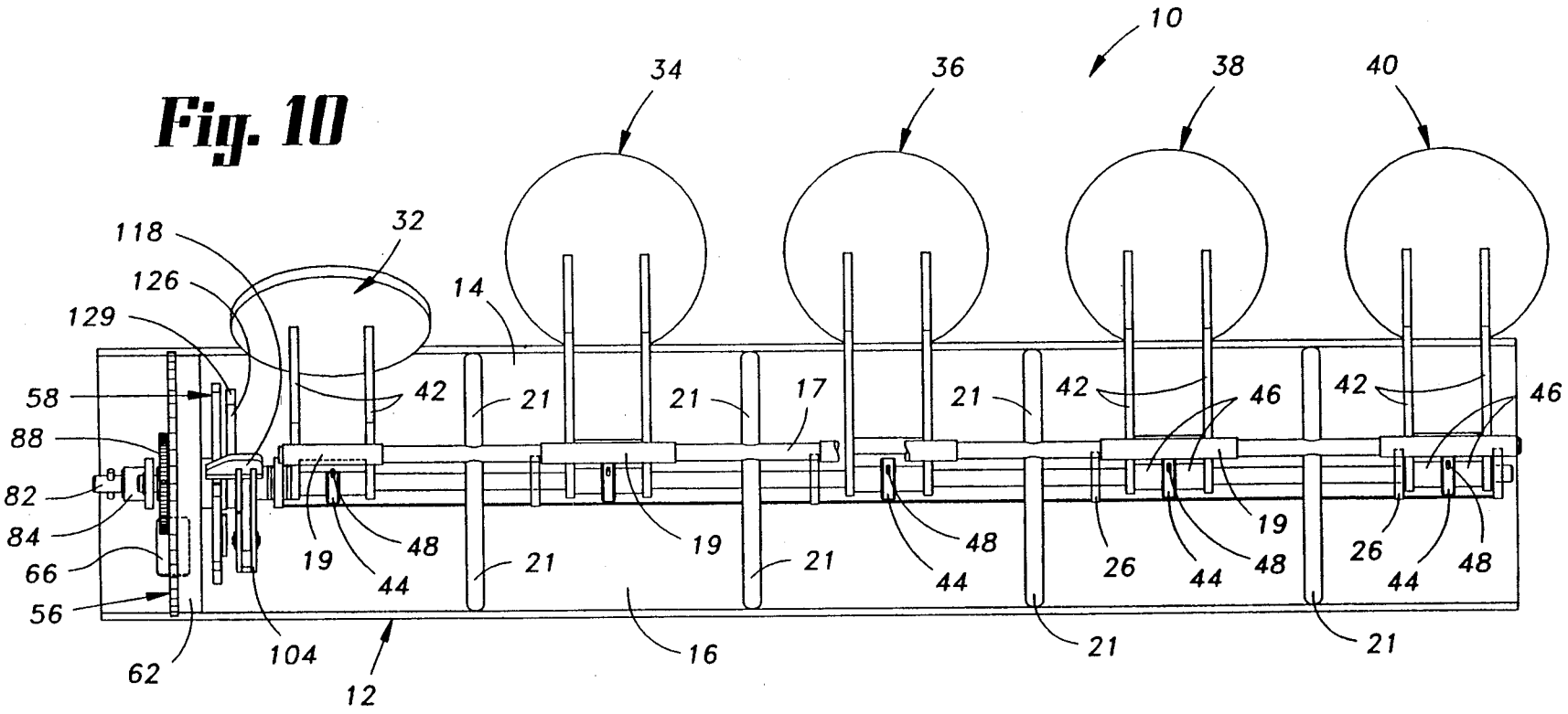
FIG. 10 is a rear elevational view of the embodiment of the invention as shown in FIG. 2.

The helically wound band spring assembly 58 is tightenable by winding in the target resetting direction 30. Winding is accomplished by engaging the radially projecting lugs 80 of a crank shaft 82 that is mounted by bearings within a boss 84, and by turning the crank shaft 82 in the direction opposite the target resetting direction 30. The crank shaft 82 has a small spur gear 86 keyed to its end opposite the crank pins 80 adjacent the inner opposite surface of the mounting bracket 20. The spur gear 86 on the crank shaft 82 is engaged with a larger spur gear 88 that is welded to the spring housing 62 on the outwardly facing disc shaped side thereof. Rotation of the crank shaft 82 in the direction opposite the target resetting direction 30 thereupon rotates the band spring housing 62 in the target resetting direction 30 so as to tighten the band spring 70 therewithin at a mechanical advantage provided by the spur gears 86 and 88. The spur gears 86 and 88 are visible in FIGS. 4, 9 and 10, but have been omitted from FIGS. 2 and 2*a* for clarity of illustration of other portions of the target system 10.

Figure 5:
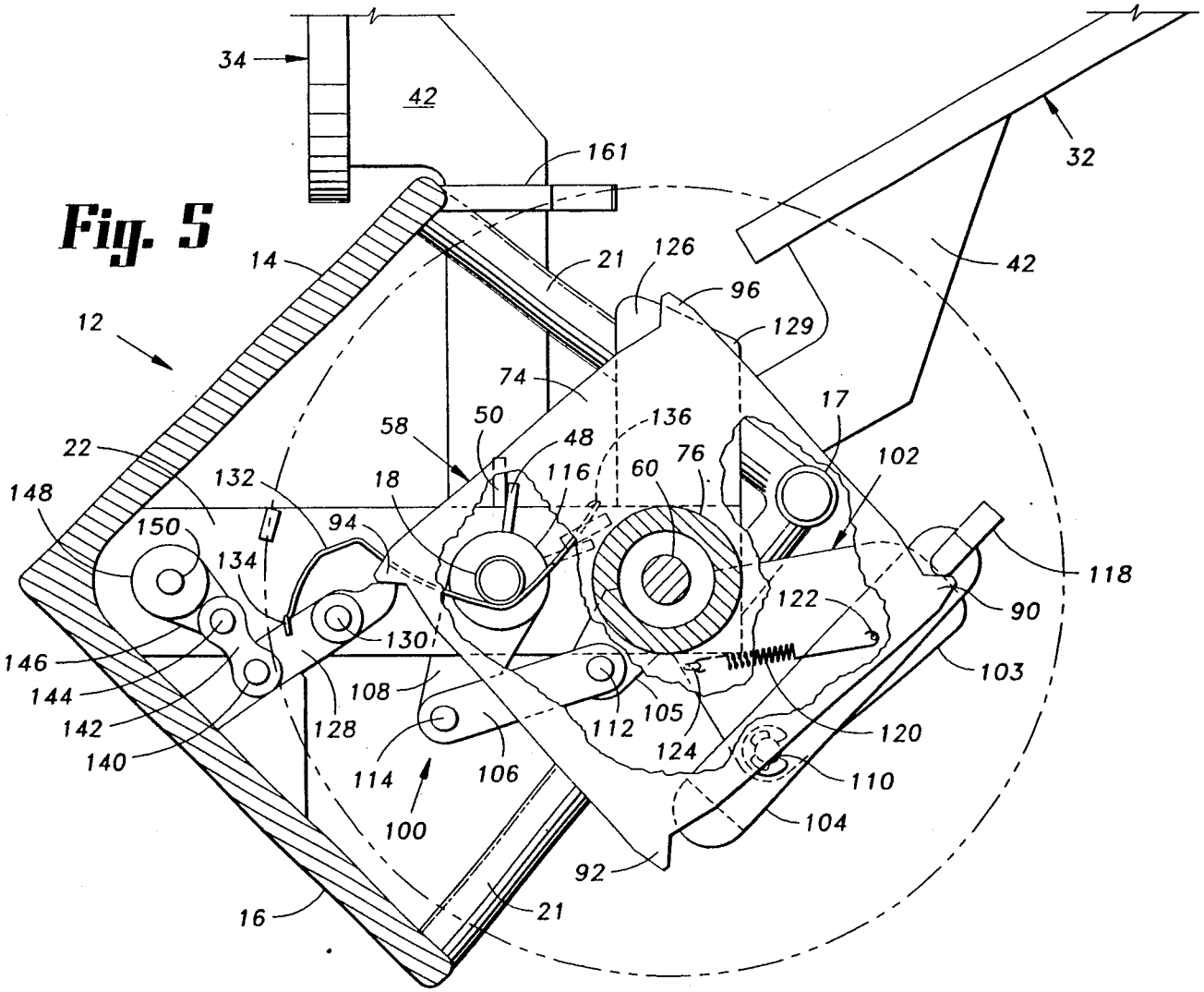
FIG. 5 is a sectional elevational view, partially broken away, taken along the lines 5—5 of FIG. 4 showing the rotation inhibiting mechanism in the engaged position.

The band spring 70 of the band spring assembly 56 applies a torque to the ratchet wheel 58, which in turn is coupled to the target mounting shaft 18 through connecting linkage indicated generally at 100 in FIG. 5. The coiled band spring 70 thereby serves to urge the target mounting shaft 18 toward rotation in the target resetting direction 30. The teeth 90, 92, 94 and 96 of the ratchet wheel 58 are separated by arcs proportional to an arcuate distance through which the targets 32–40 pass in moving between their upright and the fallen positions. The teeth 90–96 are spaced ninety degrees apart while, as previously noted, the targets 32–40 move through an arc of sixty degrees in traveling between their fallen and upright positions. Therefore, the ratio of the spacing of the teeth on the ratchet wheel 58 to the arc of travel of the targets 32–40 is 90:60, or 1.5:1. This ratio of greater than unity is chosen so as to allow the torque to be transmitted from the helically wound band spring assembly 56 to the target mounting shaft 18 at a mechanical advantage in a manner hereinafter to be described.

The connecting linkage 100, shown in FIG. 5, is interposed between the ratchet wheel 58 and the target mounting shaft 18 to rotate the target mounting shaft 18 in response to rotation of the ratchet wheel 58. The connecting linkage 100 includes a base link 102, a ratchet engaging link 104, a force transmission intermediate coupling link 106, and a force transmission coupling crank link 108.

The base link 102 has a generally triangular shaped portion 103, shown in FIG. 5, to which the ratchet engaging link 104 is mounted for rotation by means of a hinge pin 110 and an ear portion 105 to which the force transmission intermediate coupling link 106 is rotatably connected by a hinge pin 112. These hinge pins, like the others employed in the target system 10, are conventional devices and may have enlarged, flat heads at one of their ends and C-clamps, cotter pins or other retaining devices at their opposite ends. The base link 102 is welded to a sleeve like hub 114 that is journaled for rotation about the axle 60, coaxially with and independently of the ratchet wheel 58 and the helically wound band spring assembly 56. The force transmission intermediate coupling link 106 is rotatably joined to the force transmission coupling crank link 108 by another hinge pin 114. The coupling crank link 108 is welded to an annular collar 116 that is secured by radially inwardly directed set screws which immobilize the collar 116 relative to the target mounting shaft 18.

The connecting linkage 100 enhances the torque from the ratchet wheel 58 as it transmits force to the target mounting shaft 18 and rotates the target mounting shaft 18 in response to rotation of the ratchet wheel 58. The base link 102 is coupled to rotate the target mounting shaft 18 through the force transmission links 106 and 108. Since the force transmission coupling crank link 108 has a longer moment arm relative to the target mounting shaft 18 than does the ear 105 of the base link 102 relative to the axle 60, the torque provided by the helically wound band spring assembly 56 urging the ratchet wheel 58 to rotate in the target resetting direction 30 is transmitted at a mechanical advantage and applied as a larger torque to rotate the target mounting shaft 18. Thus, when the ratchet wheel 56 rotates through an arc of ninety degrees, it rotates the target mounting shaft 18 through an arc of only sixty degrees, but at a mechanical torque advantage of 1.5:1.

Figure 6:
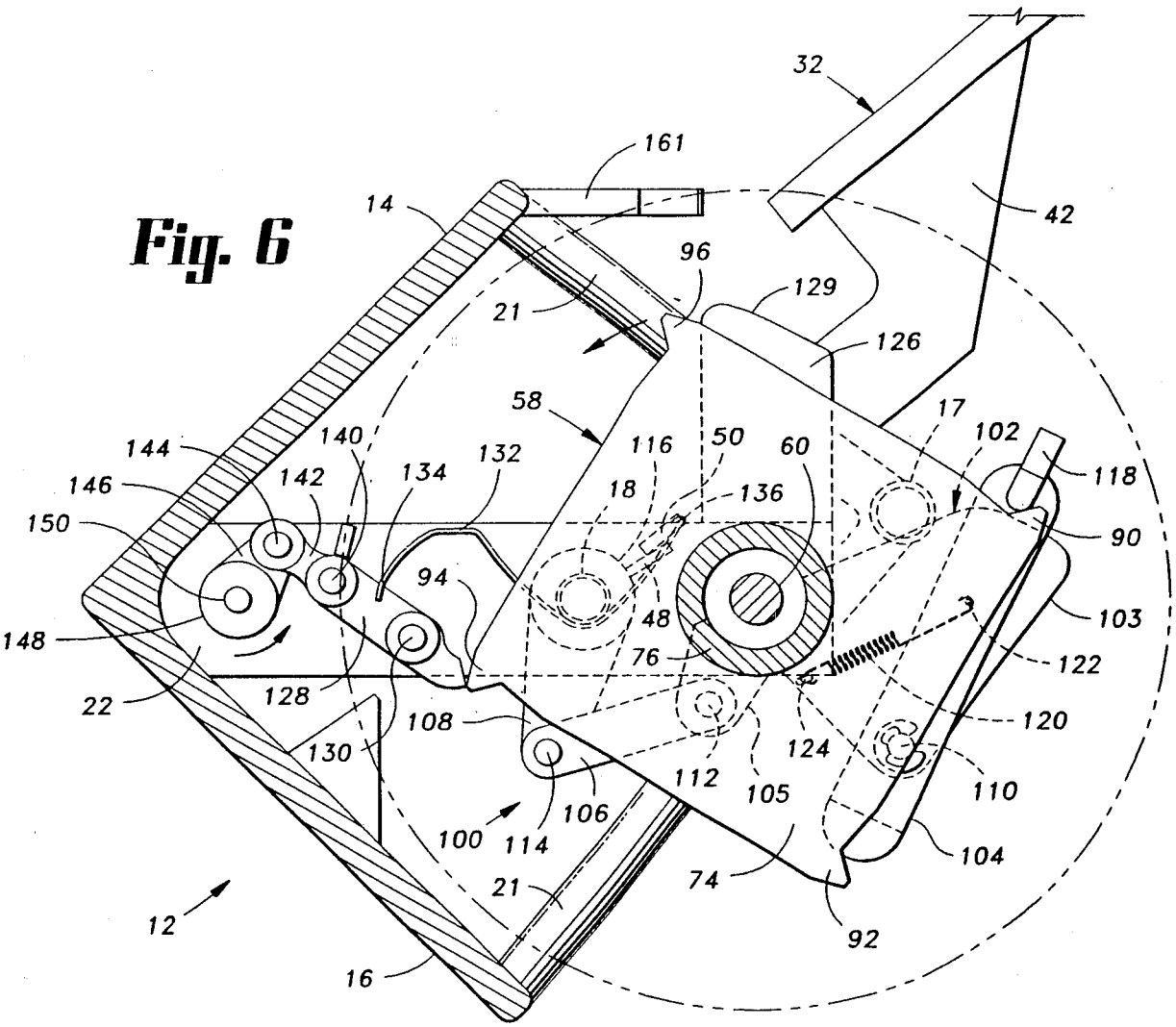
FIG. 6 shows operation of the invention as the rotation inhibiting mechanism is disabled and the target reset mechanism automatically commences operation.

The ratchet engaging link 104 is rotatably joined to the triangular portion 103 of the base link 102 by the hinge pin 110. At its extremity remote from the hinge pin 110 the ratchet engaging link 104 has a tang 118 that extends parallel to the axle 60 in a direction extending toward the helically wound band spring assembly 56. The tang 118 passes across the plane of the ratchet wheel 58 and is engageable in the alternative with the ratchet teeth 90, 92, 94 and 96. One end of a small coil spring 120 is hooked over a lug 122 on the ratchet engaging link 104 and the other end of the spring 120 is hooked over a lug 124 on the triangular portion 103 of the base link 102 proximate the hub 114. The spring 120 serves as a tang biasing means and urges the tang 118 into engagement with the tooth of the ratchet wheel 58 located immediately therebehind in a direction opposite to the target resetting direction 30. The axis of the hinge pin 110 is parallel to the target mounting shaft 18. When the tang 118 is engaged by a tooth, such as the tooth 90 as illustrated in FIGS. 5 and 6, the tang 118 serves to carry the connecting linkage 100 in rotation with the ratchet wheel 58.

Figure 7:
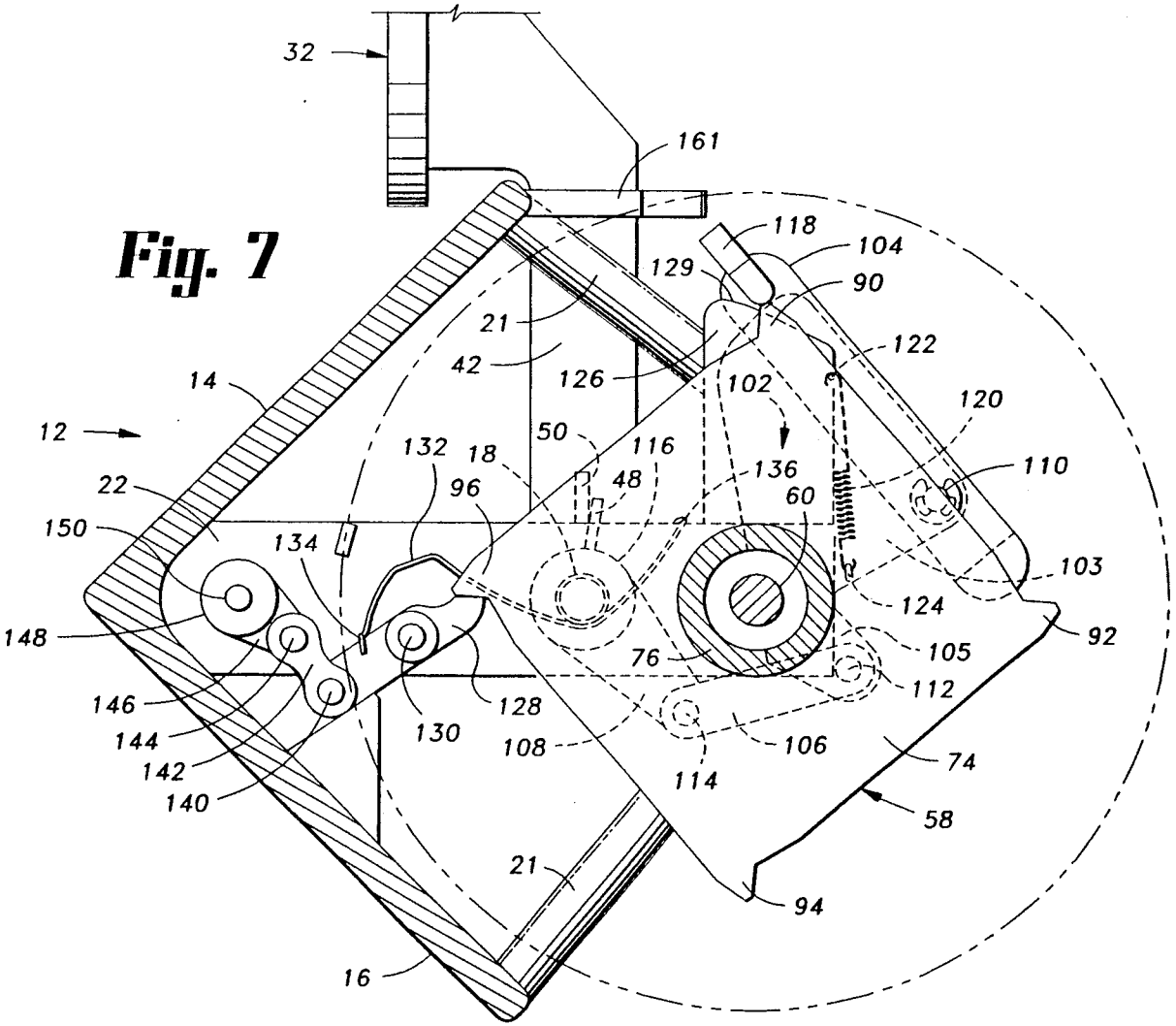
FIG. 7 shows operation of the invention as the targets are returned to their upright positions.

The target apparatus 10 also has an upright steel plate cam plate 126 that is anchored relative to the mounting frame 12 by welding to the horizontally disposed transversely extending mounting bracket 22 between the ratchet wheel 58 and the ratchet engaging link 104. The upper extremity of the cam plate 126 forms an inclined surface 129 that slopes toward the target frame 12 outwardly and away from the axle 60 to a height sufficient to dislodge the tang 118 from engagement with a tooth of the ratchet wheel 58 as that tooth passes the cam plate 126. As the ratchet wheel rotates in the direction 30, the cam surface 129 forces the tang 118 out of engagement with a first tooth, such as the tooth 90 as illustrated in FIG. 7 to let the tooth 90 pass by the tang 118. The cam plate 126 thereupon disengages the tang 118 from engagement with the tooth 90 as illustrated in FIG. 7, as the ratchet wheel 58 rotates in the target resetting direction 30 and as the targets 32–40 approach the upright position of the targets 34–40 from the fallen position of the target 32 shown in FIG. 2. The cam plate 126 thereby allows the tang 118 to engage the next adjacent tooth 92 of the ratchet wheel 58 in the direction opposite the target resetting direction 30.

The Rotation Inhibiting Mechanism

The target system 10 includes a rotation inhibiting mechanism secured to the target mounting frame 12. In the preferred embodiment of the invention illustrated the rotation inhibiting mechanism includes a type of pawl 128 which is termed a sear in the armaments trade. The sear 128 is mounted to the target mounting frame 12 by means of a hinge pin 130 that carries the sear 128 on the mounting bracket 22 on the side thereof at which the ratchet wheel 58 is mounted. The sear 128 resides in the plane of the ratchet wheel 58 and is movable in rotation between an engaged position relative to the ratchet wheel teeth 90–96, as illustrated in FIGS. 5 and 7, and a disengaged position relative to the teeth 90–96, as illustrated in FIG. 6.

A wire sear biasing spring 132 has a bent foot 134 that bears downwardly on the side of the sear 128 remote from the ratchet wheel 58, and is configured to pass beneath the target mounting shaft 18, which serves as its fulcrum. The opposite end of the wire spring 132 terminates in another bent foot 136 that is hooked over the top of the mounting bracket 22 adjacent the cam plate 126. The wire spring 132 thereby biases the sear 128 and urges the sear 128 in rotation into the path of movement of the ratchet wheel teeth 90–96, as illustrated in FIG. 5. However, the sear biasing spring 132 exerts a force which is considerably weaker than and which is overcome by the force of the band spring 70 of the reset biasing helically wound band spring assembly 56 unless the sear 128 is latched into the engaged position shown in FIG. 7.

The end of the sear 128 remote from the ratchet wheel 58 is joined by a hinge pin 140 to a short sear coupling link 142, which in turn is joined by a hinge pin 144 to a sear crank arm 146. The sear crank arm 146 is welded to an annular collar 148 that is locked by radially directed allen head set screws to the end of an elongated sear control rod 150 that protrudes through the mounting bracket 22. The sear control rod 150 extends parallel to the target mounting shaft 18 in spaced displacement therefrom near the intersection of the target mounting frame plates 14 and 16. The sear control rod passes through openings in the transversely extending mounting brackets 22, 24 and 26. The sear control rod 150 is thereby mounted to the target mounting frame 12 to control rotation of the sear 128. The sear control rod 150, together with the sear crank arm 146, the sear connecting link 142, and the sear 128, form a rotation inhibiting mechanism secured to the target mounting frame 12.

The Latch Mechanism

A latch mechanism is provided for holding the rotation inhibiting mechanism in position to obstruct rotation of the target resetting mechanism formed by the collars 44 and target resetting pins 48 in the target resetting direction 30. In the target system 10 the latch mechanism is comprised of a rotation arresting apparatus in the form of a plurality of annular collars 152 mounted coaxially about the sear control rod 150 and secured thereto by radial setscrews, and sear control rod latching pins 154 that extend radially outwardly from the annular collars 152. The sear control rod latching pins 154 move in tandem and are all aligned to reside at all times in a common plane passing through and containing the axis of the sear control rod 150. Since the collars 152 are rigidly secured and immobilized relative to the sear control rod 150, the sear control rod latching pins 154 can only move in unison, and are thereby all oriented at the same angle relative to horizontal at any give time.

The Latch Control Mechanism

The target system 10 also includes a latch control mechanism in the form of rotation locking rods 158. While a single target could be designated as a master control target to reset all of the targets, in the preferred embodiment of the invention illustrated all of the targets are provided with rotation locking rods 158. The rotation locking rods 158 include relatively long shanks which pass through spaced openings aligned with each of the targets 32–40 in a series of longitudinally aligned guide plates 160. The guide plates 160 are linearly aligned with each other and span the spaces between the mounting brackets 24 and 26 and are welded thereto. The openings in the guide plates 60 are longitudinally aligned between each pair of target mounting arms 42.

The rotation locking rods 158 have shanks approximately two and three quarter inches in length and have distal ends that bear in abutting relationship against the sides of the distal extremities of the sear control rod latching pins 154 when the targets 32–40 are in their upright positions. For maximum leverage the orientation of the rotation of the locking rods 158 when the targets 32–40 are upright is generally perpendicular to the plane in which the control rod latching pins 154 reside when the targets have been reset in their upright positions.

The proximal extremities of the rotation locking rods 158 are bent over to extend parallel to the target mounting shaft 18 and extend into openings in one of the target mounting arms 42 for each target. The bent proximal ends of the rotation locking rods 158 are secured for rotation relative to the target mounting arms 42 through which they pass by means of C-clamps, cotter pins, or other conventional fasteners.

The rotation locking rods 158 serve as a latch control mechanism, and are operated by the targets 32–40 moving from the upright position in which the targets 32–40 are shown in FIG. 2 to the fallen position in which the target 32 is shown in FIG. 2. The function of the rotation locking rods 158 is to release the latch mechanism formed by the rotation arresting collars 152 and sear control rod latching pins 154 so as to temporarily disable the rotation inhibiting sear mechanism formed by the sear 128, sear connecting link 142, sear crank arm 146 and sear control rod 150. The rotation locking rods 158 are constrained from rotation by the confines of the openings through the guide plates 160 and are limited to reciprocal movement relative to the rotation arresting sear control rod latching pins 154 and collars 152. In this way, movement of any one of the targets 32–40 to its upright position advances the rotation locking rod 158 coupled thereto into latching engagement with the sear control rod latching pin 154 aligned therewith.

The length of the sear control rod latching pins 154 can be varied in accordance with the weight of targets 32–40 and the strength of the band spring 70. The longer the length of the sear control rod latching pin 154, the greater will be the locking torque applied by the rotation locking rods 158 when the rods 158 bear against the pins 154 near the ends thereof. Thus, for heavier targets which require a more powerful band spring 70, the sear control latching pins 154 should be relatively long. For targets that do not weigh as much the pins 154 can be shorter. Indeed, for relatively light targets the pins 154 can be dispensed with entirely, and the function of arresting rotation can be performed by radial bores in the collars 152 into which the rotation locking rods can 158 extend when the targets are reset.

When the targets 32–40 reach their upright positions they are held in vertical alignment by detent spring catches 161, as best illustrated in FIG. 2. While the spring detent latches 161 contribute slightly to the force that prevents the sear control rod 150 from rotating, it is the inertial mass of any one of the targets 32–40, acting through any one of the rotation locking rods 158, that primarily prevents rotation of the sear control rod 150. With any one of the targets 32–40 in its upright position, the rotation locking rod 158 associated therewith prevents rotation of the sear control rod 150 so as to immobilize the sear 128 in the path of movement of the ratchet teeth 90–96. On the other hand, when impacting firearm shots knock all of the targets 32–40 to their fallen positions, as exemplified by the position of the target 32 in FIGS. 2 and 2*a*, all of the rotation locking rods 158 are withdrawn from both contact and from interference in the path of movement of the control rod latching pins 154. The control rod latching pins 154 thereupon temporarily permit rotation of the sear control rod 150.

Under this condition the sear 128 is held in the engaged position of FIG. 5 only by the force of the sear biasing spring 132. Since force of the helically wound band spring 70 is much more powerful than the rotation inhibiting force of the sear biasing spring 132, withdrawal of all of the rotation locking rods 158 from engagement with their respective sear control rod latching pins 154 allows the force of the band spring 70 to overcome the force of the sear biasing spring 132. As a result, the tooth 94 theretofore engaged by the sear 128, rotates the sear 128 in opposition to the force applied by the sear biasing spring 132 and pushes past the sear 128 as the ratchet wheel moves in rotation in the target resetting direction 30, as illustrated in FIG. 6. The connecting linkage 110 likewise rotates in the target resetting direction 30, since the tooth 90 is engaged with the tang 118 until the tang 118 is disengaged therefrom by the cam 126.

As the ratchet 58 rotates, the sear 128 will return from its disengaged position to its engaged position by virtue of the force applied thereto by the sear spring 132 once the tooth 94 has cleared and rotated past the sear 128, as illustrated in FIG. 7. As the ratchet wheel 58 continues to rotate, the tang 118 makes contact with the cam surface 129. With continued rotation of the ratchet wheel 58, the tang 118 is lifted upwardly and away from the ratchet wheel 58 by the cam surface 129 as the targets 32–40 approach their upright positions. However, until the tang 118 is disengaged from the tooth 90, the force of the band spring 70 continues to act through the connecting linkage 110, which rotates the target mounting shaft 18 that in turn carries the target resetting collars 44 and target engaging pins 48. The target resetting pins 48 act against the transverse target mounting arm connecting plates 50 rotate the targets 32–40 toward their upright positions.

As the targets 32–40 concurrently arrive at their upright positions illustrated in FIG. 7, the tang 118 is disengaged from the ratchet wheel tooth 90. Concurrently, the distal ends of the rotation locking rods 158 are carried in reciprocal movement and arrive into abutting relationship against the sides of the distal extremities of the control rod latching pins 154. The rotation arresting apparatus formed by the collars 152 and sear control latching pins 154 is thereupon engaged by the latch control mechanism formed by the rotation locking rods 158. Thus, the control rod latching pins 154 again latch the sear control rod 150 to hold the sear 128 in its engaged position, depicted in FIG. 5. This prevents the ratchet wheel 58 from rotating any further. The rotation locking rods 158, when engaged with the sear control rod latching pins 154, prevent the band spring 70 from overpowering the rotation inhibiting mechanism formed by the sear 128 and its biasing spring 132. This prevents further rotation of the target mounting shaft 18 in the target resetting direction 30.

Once all of the targets are in their upright positions, as illustrated in FIG. 1, the target system 10 is again primed for repetitive automatic operation. Since the latch control mechanism of the target system 10 is comprised of separate rotation locking rods 158 carried by each of the targets 32–40 for independently engaging the rotation arresting apparatus formed by the collars 152 and sear control rod latching pins 154 when any of the targets 32–40 is in the upright position, the targets 32–40, when struck one by one, will remain in their fallen positions until all targets are down. As each of the targets 32–40 is impacted, the momentum of the projectile striking the target causes each target hit to rotate rearwardly in a direction opposite to the target resetting direction 30 as it is successively hit from the upright position depicted in FIG. 7 to the fallen position in which the target 32 resides in FIG. 5. The first target to fall causes the target reset lever arms 48, the collars 44, the target mounting shaft 18 and connecting linkage 100 to rotate in a direction opposite to the target resetting direction 30, thereby bringing the tang 118 back into abutment and in engagement with the next tooth on the ratchet wheel 58.

Operation Of The Embodiment

The sequential automatic operation of the component parts of the embodiment of the invention illustrated may be described as follows. With all of the targets 32–40 in the upright positions illustrated in FIG. 1, a shooter fires at the targets. If the target 32 is the first target hit, it rotates on its pair of target mounting arms 42 from its upright position depicted in FIG. 1 to its fallen position depicted in FIG. 2. As this occurs the rotation locking rod 158 rotatably connected to the target 32 is reciprocally withdrawn from engagement with the sear control rod latching pin 154 with which it is aligned. However, because each of the rotation locking rods 158 is independently engaged with the rotation arresting apparatus formed by the collars 152 and sear control rod latching pins 154, the sear control rod 150 remains immobilized. Immobilization of the sear control rod 150 in turn immobilizes the sear 128 and holds the sear 128 in position to obstruct rotation of the target resetting levers 48 by preventing the application of force thereto by the ratchet wheel 58.

When the last of the targets has been hit and falls from its upright position to its fallen position the last rotation locking rod 158 is withdrawn from engagement with its corresponding sear control rod latching pin 154. It is only when all of the rotation locking rods 158 have been reciprocally withdrawn and all of the targets 32–40 are in the fallen position concurrently that the sear latch mechanism is disabled. Once this occurs, however, the target resetting mechanism begins its automatic operation.

When all of the targets are in the fallen position, the sear control rod 150 is no longer immobilized by engagement of any one of the sear control rod latching pins 154. Under these conditions, the far more powerful force of the band spring 70 overcomes the countervailing force of the sear biasing spring 132, thus allowing the ratchet wheel 58 to push past the sear 128 to rotate in the target resetting direction 30, as illustrated in FIG. 6. The force of the band spring 70 is transmitted with an enhanced torque through thee connecting linkage 100 by virtue of engagement of the tang 118 with the ratchet wheel tooth 90. As the ratchet wheel tooth 90 advances in the target resetting direction 30, the connecting linkage 100 is likewise rotated, thereby rotating the target mounting shaft 18 and the target levers 48. The target resetting levers 48 concurrently push upwardly in rotation in the target resetting direction against the cross braces 50 of the mounting arms 42 associated therewith.

As the targets 32–40 approach their upright positions, the cam 126 disengages the tang 118 from the ratchet wheel tooth 90. Concurrently, the rotation locking rods 158 engage their respective sear control rod latching pins 154 and counterrotate the sear control rod 150. Since the rotation locking rods 158 again engage the rotation arresting sear control rod latching pins 154, the sear 128 is once again immobilized in the path of the ratchet wheel 58 and prevents its rotation. Because the tang 118 has been dislodged from the ratchet wheel tooth 90, it will be forced down into engagement with the next successive ratchet wheel tooth 92 in the direction opposite the target resetting direction 30 the next time that any one of the targets 32–40 is struck and rotates from its upright to its fallen position.

It should be understood that numerous variations and modifications of the invention are possible. For example, gears could be substituted for the connecting linkage 100 in order to achieve the mechanical advantage desired. Also, while the helically wound band spring assembly 56 and ratchet wheel 58 are mounted about an axle 60 separate and laterally displaced from the axis of rotation of the target resetting shaft 18, in order to achieve enhanced torque in the transmission of force to the target resetting mechanism, for lighter targets this is unnecessary. In such a situation the reset biasing means may be mounted coaxially with the target resetting shaft and a somewhat simpler latch mechanism and latch control mechanism such as a simple spring biased pawl may be employed. Accordingly, this invention should not be construed as limited to the specific embodiment of the invention illustrated and described.

I claim:

1. In a target apparatus employing a plurality of targets fastened to a target mounting frame in which each target is independently mounted for and rotation about a common horizontal target mounting shaft between an upright position and a lower, fallen position, the improvement comprising:

a target resetting mechanism rigidly secured to said target mounting shaft and operable to rotate in a target resetting direction to engage all of said targets that reside in said fallen position so as to concurrently rotate them into said upright position reset biasing means coupled to said target resetting mechanism to urge said target resetting mechanism in rotation in said target resetting direction, a rotation inhibiting mechanism secured to said target mounting frame, a latch mechanism for holding said rotation inhibiting mechanism in position to obstruct rotation of said target resetting mechanism in said target resetting direction, and a latch control mechanism operated by at least one of said targets moving from said upright position to said fallen position to release said latch mechanism so as to temporarily disable said rotation inhibiting mechanism,

2. A target apparatus according to claim 1 wherein said target resetting mechanism is comprised of a plurality of separate collars all secured to said target mounting shaft for concurrent rotation therewith and a target reset lever arm projecting radially outwardly from each of said collars and said target reset lever arms are configured to engage said targets to carry them in rotation about said target mounting shaft in said target resetting direction upon contact therewith when said target mounting shaft is rotated in said target resetting direction.

3. A target apparatus according to claim 2 wherein said target resetting mechanism comprises a ratchet wheel having a plurality of teeth separated by arcs proportional to an accurate distance through which said targets pass in moving between said upright and said fallen positions, wherein said biasing means urges said ratchet wheel to rotate in said target resetting direction, connecting linkage secured to said target mounting shaft including a base link mounted for rotation coaxially with said ratchet and independently thereof and coupled to rotate said target mounting shaft therewith and a ratchet engaging link rotatably joined to said base link for rotation about an axis parallel to Said target mounting shaft and having a laterally projecting tang engageable by said teeth of said ratchet wheel to carry said connecting linkage in rotation therewith, tang biasing means urging said tang toward engagement with said ratchet teeth, and a cam anchored relative to said mounting frame and lying in the path of movement of said tang to disengage said tang from engagement with a tooth of said ratchet wheel so that it passes over said tooth of said ratchet wheel as said ratchet wheel rotates in said target resetting direction and as said at least one of said targets approaches said upright position from said fallen position so as to allow said tang to engage the next adjacent tooth of said ratchet wheel in the direction opposite said target resetting direction, and said rotation inhibiting means is comprised of a sear mounted for rotation relative to said target mounting frame and engageable with said teeth of said ratchet wheel and sear biasing means urging said sear in rotation into the path of movement of said ratchet teeth.

4. A target apparatus according to claim 3 wherein said latch mechanism is comprised of a sear control rod coupled to said sear to control the rotational movement thereof and mounted on said target mounting frame to extend parallel to said target mounting shaft, and at least one rotation arresting device rigidly secured to said sear control rod, and said latch control mechanism is comprised of a rotation locking rod carried by said at least one of said targets, and means for constraining said rotation locking rod to reciprocal movement relative to and in longitudinal alignment with said rotation arresting device, whereby movement of said at least one of said targets to said upright position advances said rotation locking rod into latching engagement with said rotation arresting device, thereby preventing rotation of said sear control rod so as to immobilize said sear in said path of movement of said ratchet teeth when said at least one of said targets is in said upright position, and movement of said a least one of said targets to said fallen position withdraws said rotation locking rod from latching engagement with said rotation arresting device to permit rotation of said sear control rod and said sear.

5. A target apparatus according to claim 4 wherein said latch mechanism is further comprised of a plurality of rotation arresting devices as aforesaid one for each of said targets, secured in longitudinal separation from each other along said sear control rod, and said latch control mechanism is comprised of a separate rotation locking rod as aforesaid carried by each of said targets, whereby the disposition of any one of said targets in said upright position maintains the rotation locking rod which it carries in latching engagement with the rotation arresting device for the same target with which it is longitudinally aligned.

6. A target apparatus according to claim 3 wherein said connecting linkage further comprises force transmission coupling means interposed between said base link and said target mounting shaft whereby the torque of said reset biasing means urging said ratchet wheel to rotate is transmitted at a mechanical advantage and applied as a larger torque to rotate said target mounting shaft.

7. A target apparatus according to claim 1 further comprising a ratchet wheel having a plurality of teeth and coupled to turn said target mounting shaft in rotation therewith, and wherein said rotation inhibiting mechanism is comprised of a sear mounted to said target mounting frame for movement in rotation relative thereto, a sear spring biasing said sear toward said ratchet wheel and into the path of movement of said ratchet teeth, and said latch mechanism is comprised of a rotation arresting apparatus coupled to said sear and engageable by said latch control mechanism to hold said sear in said path of said ratchet teeth so as to obstruct rotation of said ratchet wheel when said at least one of said targets is in said upright position, and said reset biasing means is coupled to urge said ratchet wheel towards rotation in said target resetting direction and is more powerful than said sear 'spring and overcomes the force of said sear spring to push said sear out of said path of movement of said ratchet teeth whereby said rotation inhibiting mechanism is disabled unless said rotation arresting apparatus is engaged by said latch control mechanism.

8. A target apparatus according to claim 7 further characterized in that said rotation arresting apparatus is comprised of a plurality of rotation arresting devices each of which is associated with a separate one of said targets, and said latch control mechanism is comprised of a plurality of rotation locking members, each of which is carried by a separate one of said targets and is engaged with said rotation arresting device for the same target when said same target is in said upright position and disengaged from the latching device for the same target when said same target is in said fallen position, whereby said sear obstructs rotation of said ratchet wheel unless all of said targets are concurrently in said fallen position.

9. A target apparatus according to claim 7 further comprising connecting linkage interposed between said ratchet wheel and said target mounting shaft to rotate said target mounting shaft in response to rotation of said ratchet wheel including a base link coupled to rotate said target mounting shaft and mounted for rotation coaxially with said ratchet wheel and independently thereof, a ratchet engaging link rotatably joined to said base link and including a tang engageable in said ratchet teeth, a tang biasing means urging said tang into engagement with a first tooth located immediately therebehind on said ratchet wheel in a direction opposite said target resetting direction, and means for forcing said tang out of engagement with said first tooth to let said first tooth pass by said tang.

10. A target apparatus according to claim 1 further characterized in that said reset biasing means acts against and is more powerful than said rotation inhibiting mechanism, and said latch mechanism includes a rotation arresting apparatus engageable by said latch control mechanism which, when engaged, prevents said reset biasing means from overpowering said rotation inhibiting mechanism thereby preventing rotation of said target mounting shaft in said target resetting direction, and said latch control mechanism is comprised of separate rotation locking members carried by each of said targets for independently engaging said rotation arresting apparatus when any one of said targets is in said upright position, thereby allowing said reset biasing means to overcome and temporarily disable said rotation inhibiting means only when all of said targets are concurrently in said fallen position.

11. An automatically resettable shooting target system comprising:

a target mounting frame, a horizontally disposed target mounting shaft secured to said target mounting frame for rotation relative thereto in both a target resetting direction and in an opposite direction, a plurality of targets mounted for rotation independently of each other relative to said target frame and about said target mounting shaft, whereby said targets each fall upon impact from an upright position to a fallen position vertically lower than said upright position, a target reset mechanism coupled to said target mounting shaft to rotate therewith for engaging said targets from behind and for rotating said targets together from their fallen positions to their upright positions upon rotation of said target mounting shaft in said target resetting direction, and including a ratchet wheel having a plurality of teeth and coupled to said target mounting shaft, reset biasing means for urging said target mounting shaft for rotation in said target resetting direction by means of said ratchet wheel, and a pawl secured to said target mounting frame and movable between engaged and disengaged positions relative to said teeth of said ratchet wheel, a pawl latch mechanism which holds said pawl in said engaged position to prevent said ratchet wheel from rotating and to restrain said target mounting shaft from rotating in said target resetting direction, and pawl latch mechanism control means actuated by a least one of said targets moving from said upright position to said fallen position to temporarily disable said pawl latch mechanism, thereby temporarily allowing said reset biasing means to move said pawl from said engaged to said disengaged position which allows said target mounting shaft to rotate in said target resetting direction until said target reset mechanism brings all of said targets to said upright position together, whereupon said pawl latch mechanism is enabled with said pawl in said engaged position.

12. An automatically resettable shooting target system according to claim 11 further comprising a pawl biasing means which urges said pawl toward said engaged position in the path of said ratchet wheel teeth with a force which is weaker than and overcome by the force of said reset biasing means unless said pawl latch mechanism is disabled.

13. An automatically resettable shooting target system according to claim 12 wherein said reset biasing means is a helically wound band spring assembly mounted coaxially with said ratchet wheel and which is tightenable by winding in said target resetting direction.

14. An automatically resettable shooting target system according to claim 13 further comprising torque enhancing coupling means interposed between said ratchet wheel and said target mounting Shaft to increase the torque transmitted from said ratchet wheel to said target reset mechanism.

15. An automatically resettable shooting target system according to claim 11 wherein all of said targets carry separate rotation locking devices that all engage said pawl latch mechanism when said targets are in said upright position, and in the aggregate said rotation locking devices form said pawl latch mechanism control means, whereby said pawl latch mechanism is disabled only when all of said targets are concurrently in said fallen position.

16. An automatically resettable shooting target system according to claim 15 wherein said pawl latch mechanism is comprised of a pawl control rod mounted on said target mounting frame and extending parallel to said target mounting shaft and coupled to said pawl and including rotation arresting means thereon which, when engaged, prevent rotation of said pawl control rod and maintain said pawl in said engaged position, and said of separate rotation locking means carried by each of said targets engage said rotation arresting means when said target associated therewith is in said upright position and disengage said rotation arresting means when said target associated therewith is in said fallen position.

17. An automatic shooting target system comprising:

a target mounting frame, a horizontally disposed target mounting shaft secured to said target mounting frame for rotation relative thereto in both a reset direction and an opposite direction, a plurality of targets each carried by separate sets of target mounting arms which are mounted for independent rotation about said target mounting shaft, wherein said targets are rotatable relative to said target mounting frame between upright positions and fallen positions that are at a vertically lower level than said upright position, a target reset mechanism secured to and rotatable with said target mounting shaft and having lever means for engaging said targets to concurrently bring all of said targets to said upright positions when said mounting shaft rotates in said reset direction, reset biasing means coupled to urge said target mounting shaft in rotation in said reset direction, rotation inhibiting means for obstructing rotation of said target mounting shaft in said reset direction, and control means operable by movement of a least one of said targets from an upright to a fallen position to temporarily disable said rotation inhibiting means, thereby allowing said reset biasing means to rotate said target mounting shaft in said reset direction, whereby said target reset mechanism concurrently carries all targets in said fallen position to said upright position.

18. An automatic shooting target system according to claim 17 wherein all of said targets carry separate control elements that are individually engaged with said rotation inhibiting means when said targets are in said upright positions and disengaged therefrom when said targets are in said fallen positions, whereby said rotation inhibiting means is disengaged only upon concurrent disengagement of all of said control elements from said rotation inhibiting means.

19. An automatic shooting target system according to claim 18 further comprising a ratchet wheel, and wherein said reset biasing means is comprised of a helical band spring assembly coupled to apply torque to said target mounting shaft through said ratchet wheel, and said rotation inhibiting means is comprised of a sear rotatably mounted relative to said target mounting frame, and further comprising a control rod mounted to said target mounting frame to control rotation of said sear and a rotation arresting assembly secured to said sear control rod, and said control means is comprised of a control element carried by a target arm of said at least one of said targets to engage and immobilize said rotation arresting assembly, said sear control rod, and said sear when said at least one of said targets is in its upright position.

* * * * *